US008113696B2

(12) United States Patent
Striebel et al.

(10) Patent No.: US 8,113,696 B2
(45) Date of Patent: Feb. 14, 2012

(54) UNIVERSAL LIGHT BALL AND TUBE LIGHT SYSTEM

(76) Inventors: Roman F. Striebel, Duxbury, MA (US); Michael Rowell, Holbrook, MA (US)

( * ) Notice: Subject to any disclaimer, the term of this patent is extended or adjusted under 35 U.S.C. 154(b) by 347 days.

(21) Appl. No.: 12/435,489

(22) Filed: May 5, 2009

(65) Prior Publication Data

US 2010/0284179 A1 Nov. 11, 2010

(51) Int. Cl.
*F21V 19/02* (2006.01)
*F21S 8/00* (2006.01)
*F21L 4/00* (2006.01)

(52) U.S. Cl. ..... 362/372; 362/152; 362/196

(58) Field of Classification Search ..... 362/152, 362/196, 202, 275, 372, 249.06, 220, 217.1, 362/249.1, 429, 555, 470, 471, 479, 488, 362/490, 505, 523, 528, 529, 530, 531, 532, 362/543, 544, 545, 546, 548, 549, 219, 217.02, 362/249.02, 249.03, 249.14, 285, 287, 362, 362/418

See application file for complete search history.

(56) References Cited

U.S. PATENT DOCUMENTS

| | | | | |
|---|---|---|---|---|
| 4,751,627 | A * | 6/1988 | Usher | 362/421 |
| 4,760,507 | A * | 7/1988 | Lasker et al. | 362/239 |
| 6,676,278 | B2 | 1/2004 | Striebel et al. | |
| 7,168,843 | B2 | 1/2007 | Striebel | |
| 7,251,126 | B2 * | 7/2007 | Stephany et al. | 361/679.27 |
| 7,473,006 | B1 * | 1/2009 | Bollman | 362/152 |
| 7,635,201 | B2 * | 12/2009 | Deng | 362/249.02 |
| 7,677,759 | B1 * | 3/2010 | Leung | 362/232 |
| 7,891,841 | B2 * | 2/2011 | Levine | 362/249.07 |
| 2006/0198155 | A1 * | 9/2006 | Nickola et al. | 362/488 |
| 2007/0263388 | A1 * | 11/2007 | Lai et al. | 362/287 |
| 2009/0129108 | A1 * | 5/2009 | Shih | 362/523 |

* cited by examiner

*Primary Examiner* — David Crowe
(74) *Attorney, Agent, or Firm* — Burns & Levinson LLP; Jacob N. Erlich; Marlo S. Grolnic

(57) ABSTRACT

A universal light ball system has a light source with a substantially round housing disposed within a substantially elongated housing so that the light source may be directed by changing the orientation of the substantially round housing relative to the substantially elongated housing. The substantially elongated housing may be inserted into another member such as a the hollow top of landscape edging in order to provide unobtrusive and aesthetically pleasing landscape lighting.

17 Claims, 10 Drawing Sheets

UNIVERSAL LIGHT BALL AND TUBE LIGHT SYSTEM

BACKGROUND

The present teachings relate generally to low voltage electrical lighting and, more particularly, to easily installed, directional light systems for use with indoor and outdoor applications such as, although not limited thereto, landscape edging.

Conventional landscape lighting exists in the form of light emitting diode (LED) "stake lighting", LED-powered "rope lights," and floodlights. These conventional light systems suffer from many problems. For instance, they can not be directed in a specific direction to provide subtle illumination near the ground, such as near landscape borders and walkways. Floodlights, in particular, bathe a wide area in bright light. Stake lights and rope lights, on the other hand, generally cannot focus light on a particular area. These conventional lighting systems are obtrusive, can be seen during normal daylight hours, and may also interfere with landscaping activities such as pruning and mowing. In addition, they often have issues with moisture or snow, causing them to short-circuit and break.

What is needed is a superior lighting system that solves these and other problems, and directs light near a targeted area in an unobtrusive and attractive way.

SUMMARY

The needs set forth herein as well as further and other needs and advantages are addressed by the present embodiments, which illustrate solutions and advantages described below.

The system of the present embodiment includes, but is not limited to, a light source having a substantially round housing disposed in a substantially elongated housing so that adjusting the orientation of the substantially round housing relative to an opening in the substantially elongated housing directs the light source.

Other embodiments of the system are described in detail below and are also part of the present teachings.

For a better understanding of the present embodiments, together with other and further aspects thereof, reference is made to the accompanying drawings and detailed description, and its scope will be pointed out in the appended claims

DETAILED DESCRIPTION

Figure 1:
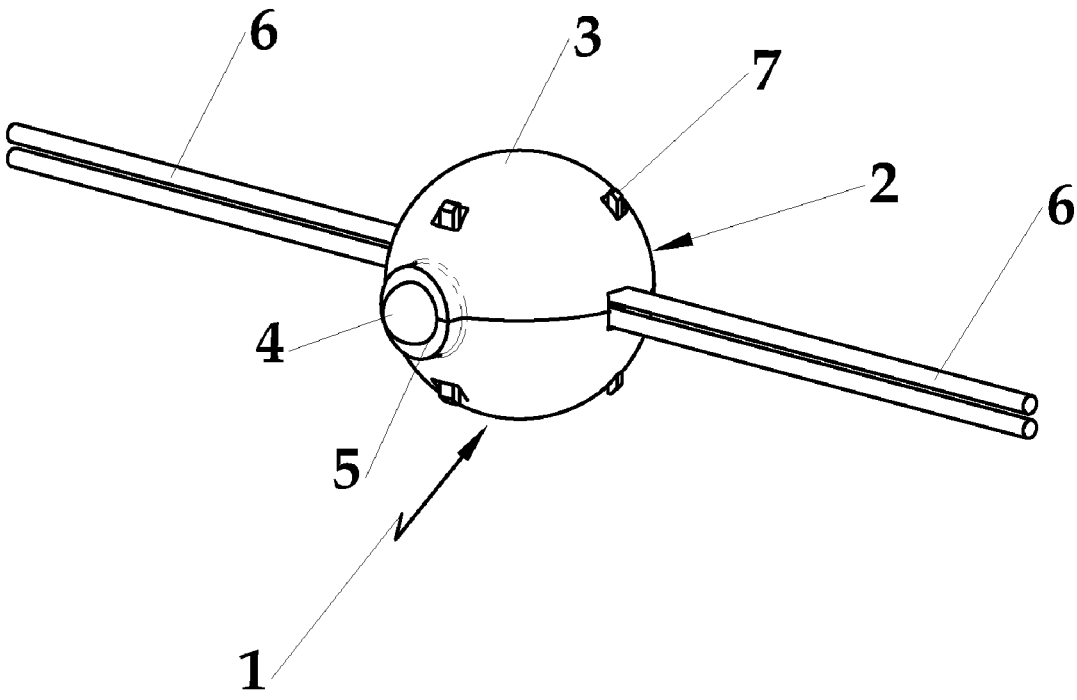
FIG. 1 is a pictorial view of one embodiment of the light ball assembly.

The present teachings are described more fully hereinafter with reference to the accompanying drawings, in which the present embodiments are shown. The following description is presented for illustrative purposes only and the invention should not be limited to these embodiments.

As discussed above, conventional landscape lighting systems are obtrusive and do not have the ability to direct light in a specific direction near a target area in a subtle way. The universal light ball system addresses these and other shortcomings, discussed further below, by incorporating into the hollow profile of landscape edging or indoor molding, although not limited thereto.

Landscape edging (also referred to as "lawn edging" or "garden edging") exists to define borders between areas such as, for example, although not limited thereto, a lawn and a mulched garden bed. Landscape edging can be metal, plastic, wood, brick or a number of other materials, so long as it gives the look of a clean edge. Many people prefer the finished look that a clean edge lends to a landscape design. Landscape edging also provides functional benefits such as: 1) containing lawn grasses, which spread via stolons, so that grass does not start growing in planting beds; and 2) containing mulch in a planting bed, preventing it from spilling out.

Landscape edging generally comes in long rectangular sections with a "lip" formed of a partially hollow top to strengthen the portion of the edging above ground. The bottom side is buried at the border of two areas so that the landscape edging frames and separates the two areas. The universal light ball system, discussed further below, may be installed in the otherwise wasted space in the hollow edging top to direct light in a subtle way close to the ground. The universal light ball system may be incorporated into landscape edging during the manufacturing process or may also retro-fit existing landscape edging. Such a lighting system is highly desirable to illuminate adjacent walkways for safety and visibility at night or in poor visibility. Illumination of lawn and shrubbery adds safety lighting at night and is aesthetically pleasing. Conventional landscape lighting systems can not be used in this fashion and are conspicuous, detracting from the aesthetics of the scenery.

The universal light ball system may comprise a light source disposed in a round light ball housing, which is then disposed in an elongated housing. The round housing permits the light source to be directed by changing its orientation in relation to an opening in the elongated housing. The elongated housing may then be partially disposed in or incorporated in some manner with another member, such as the hollow edging top of landscape edging. In this way, the universal light ball system maintains a low profile but provides directional light to needed areas.

The round housing of an assembled light ball may comprise two substantially similar halves that are preferably injection molded plastic for lower cost, but can be made from other material, and could be formed as identical parts. The assembled light ball may have at least one LED light mounted directly on a printed circuit board, but not limited thereto, that also carries at one or both of its ends at least one electrical wire. The universal light ball system will preferably be able to be powered from either end. The halves may each carry a suitable recess that is shaped to accommodate the light ball subassembly of the LED, the printed circuit board with components, and the electrical wires. The printed circuit board with the mounted LED may be oriented to a desired opening in the assembled light ball that permits the light be directed out, and may also may protect the LED from the elements. If desired, the printed circuit board can also accommodate further LEDs oriented in the same or different directions, a rectifier, or a number of other electronic components.

After placing the light ball subassembly into the round housing, the components may be embedded in an epoxy compound or some other sealant for water and damage resistance. The assembled light ball may have a suitable opening through which some protective substance can be injected, thus making the whole assembly highly resistant to water, dirt, sunlight and damage. Especially for use with landscape edging, one advantage, although not limited thereto, is to allow the universal light ball system, containing the assembled light ball, to be secured together by being glued and to not depend on the tolerances of the landscape edging to hold it together. Such a lighting system is a durable and maintenance free, and can easily be replaced as an element of a landscape lighting system if it ceases to function properly.

The use of the universal light ball system in landscape edging utilizes an elongated housing that is designed as to fit inside commercially available hollow top lawn edging profiles. Since not all landscape edgings have identical sizes, the system allows a variation of shapes and sizes of the elongated housing, as well as variation in the size of the assembled light ball.

A suitable elongated housing may be preferably formed by plastic injection molding, or some other suitable construction method, of two elongated halves, which may be substantially identical to reduce manufacturing costs. Each elongated half may contain a suitable recess for the assembled light ball, which can be rotatable left and right, although not limited thereto, to direct the light source therein. Since the outside of the elongated housing fits inside the edging profile, the light source can be rotated both up and down inside the landscape edging and left and right inside the elongated housing. It is therefore possible to precisely direct the light alongside a walkway on one side, to rotate the elongated housing and illuminate the landscape behind the edging, or to direct the light to another object on either side and/or above the edging.

A further feature on the outside of the round housing of the assembled light ball is the provision of three, although not limited thereto, "preload pads" on each half. The preload pads, discussed further below, each form a "flexure" that allows the ball to be inserted into the elongated housing with predetermined friction. Each preload pad is recessed into the housing of the assembled light ball, which prevents the flexure from bending too far during insertion into the elongated housing.

The elongated housing may also serve to hold two adjoining landscape edging sections together, and can provide protection for electrical connections with further light fixtures or a power source. In another embodiment, the elongated housing could incorporate one or more plates or some other fixture that affixes to the two adjoining sections of landscape edging by fasteners or other suitable means.

The elongated housing may also incorporate preload pads on its outer surface, thus providing flexure with a predetermined friction between the outside of the elongated housing and the inside of the landscape edging hollow top. The entire lighting system has very few moving parts and is very easy to install. It may provide a compact and pleasing appearance that blends into the respective application, without being too obvious during the daylight hours. Stake lights, in particular, are very noticeable, suffer from maximum exposure to the elements, and are not suitable to direct light into a specific direction.

The universal light ball may provide a modular "Light Ball Building Block" which can be incorporated with other components. Each time an additional universal light ball system is added, a connection with electrical wires is required. In the preferred embodiment, commercially existing "snap connectors" that do not require wire ends to be stripped may be used for this purpose. One connector may be placed into each side of the hollow end section of the elongated housing, protected and invisible from the outside, and preferably a sufficient length of electrical wire is incorporated that allows the light ball to be easily removed and replaced later, if such replacement is ever required.

In one embodiment, the hollow top section of commercially available landscape edging may be used to carry the electrical wires from one universal light ball system to the next, and to eventually connect such wires to a power supply. Thus, the described example of a lighting system for landscape edging may comprise a plurality of universal light ball systems connected in series. The hollow edging top protects these wires from damage and moisture and makes the electrical wires invisible. The entire lighting system is unobtrusive and nearly invisible during daylight hours when the light is not in use.

The power supply is preferably provided with a light sensor, however, the light sensor may be in other locations to control the lighting system. In this way the system could be automated. The power supply could come from solar power, batteries, the electric grid, or any other suitable power source.

Although a specific light ball assembly is disclosed, many other combinations and shapes are possible, manufactured by way of injection molding or otherwise, in any number of different shapes, some of which are disclosed in the drawings. There are also different methods for mounting the light ball, depending on the shape of the housing chosen, or the requirement of mounting on either a horizontal or vertical surface. The light ball may also accommodate a plurality of LEDs or other light sources in order to provide more powerful light or light in multiple different directions at once. In addition, the light source may be a strobe light, colored light, or no light at all. Instead, a directional motion detector or some other sensor may be used and the system may act as a covert security system.

The elongated housing could also be designed to act on its own, without being inserted into another member, and may be used just as easily inside as outside. For instance, it could be incorporated into decorative molding, or used to light a staircase or artwork in an unobtrusive way. As an illustration of a further application, the light ball may be installed on the surface or into a custom extruded edging for corridors in building, to provide low level lighting during off-peak hours, or for emergency lighting when connected to backup power supply. It may also be installed into a typical drop ceiling for the same purpose or as accent lighting. Furthermore, the light ball may be installed into the hollow core of PVC fencing to provide perimeter light, or it may be installed into any other hollow-cored structure for interior or exterior use. In fact, any place where light is desirable is a potential use for the universal light ball system.

The universal light ball system comprises very few modular parts so that it can be displayed and marketed in an efficient manner to the consumer. It may be packaged so that it can be assembled or installed with the most basic tools by the average homeowner, landscaper or contractor. The universal light ball system is easy to produce at low cost, can be adapted to different uses and materials, allows flexibility when a user requires lights at irregular or regular intervals, is easy to install or replace sections, has few moving parts and is virtually maintenance free, and is able to be run at very low cost.

Referring now to FIG. 1, shown is a pictorial view of one embodiment of the light ball assembly 1. In this embodiment, the light ball assembly 1 comprises an assembled light ball 2 and electrical wires 6, which provide power thereto. The electrical wires 6 may come out of one or more sides of the assembled light ball 2 and each electrical wire 6 may comprise a single supply wire or both a supply and return wire (as shown).

The assembled light ball 2 comprises two semispherical halves 3, which may be substantially identical in shape to lower production costs, and may be molded from plastic, but not limited thereto, or constructed by some similar method of manufacture. A light source 4 may be contained within the assembled light ball 2, and may be framed by a suitable reinforced light recess 5. The light source 4 may be an LED for lower operating costs, but any type of light device may be used and there may be more than one in each assembled light ball 2. The reinforced light recess 5 provides an opening for the light source 4 to direct light out of the assembled light ball 2. A suitable number of preload pads 7 may be located on the outer surface of the assembled light ball 2 to provide for friction when it is disposed in another, enveloping housing, such as the elongated housing, discussed below.

Figure 2A:
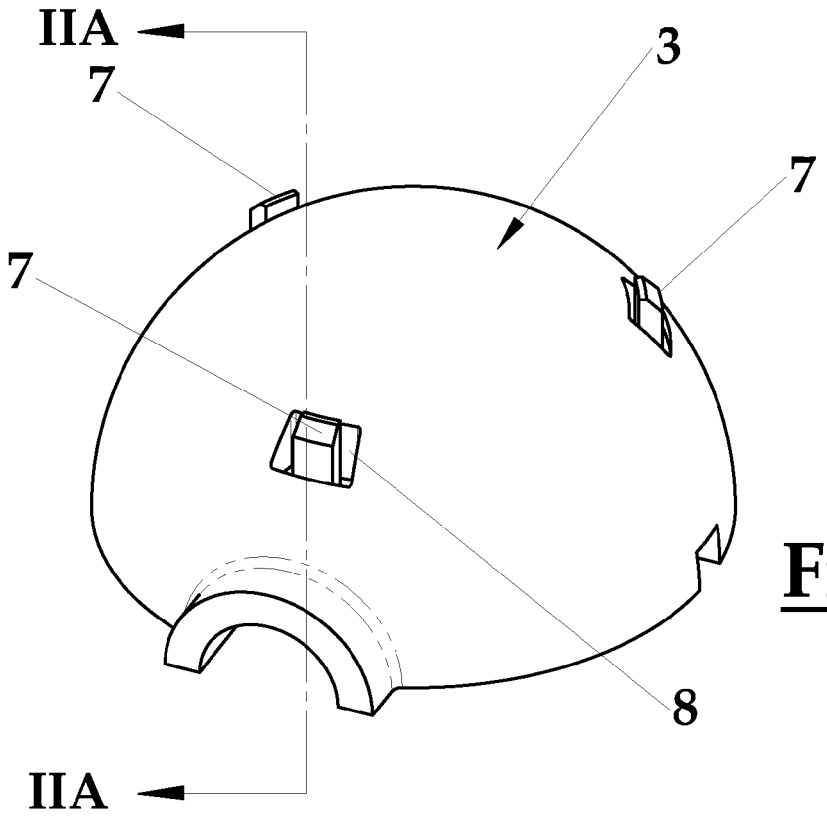
FIG. 2*a* is a pictorial view of one embodiment of one semispherical half of the light ball housing.

Referring now to FIG. 2*a*, shown is a pictorial view of one embodiment of one semispherical half 3 of the light ball housing. The preload pads 7, shown in more detail, act as a flexure inside of the housing. Each preload pad 7 is contained within a protected pad recess 8 of the housing to prevent flexure from bending too far and breaking during final assembly. The exposed part of each preload pad 7 that extends beyond the housing surface provides friction when the assembled light ball 2 is disposed in an enveloping housing, discussed further below. By altering the shape and size of the exposed part of each preload pad 7, the amount of friction between the assembled light ball 2 and an enveloping member such as elongated housing, discussed further below, can be adjusted. The assembled light ball 2 may be oriented in a particular position within the elongated housing and the friction provided by the preload pads 7 assures the orientation will remain fixed. Flexure allows the preload pads 7 to bend within each protected pad recess 8, but they remain protected so that they will not bend too far and break.

Figure 2B:
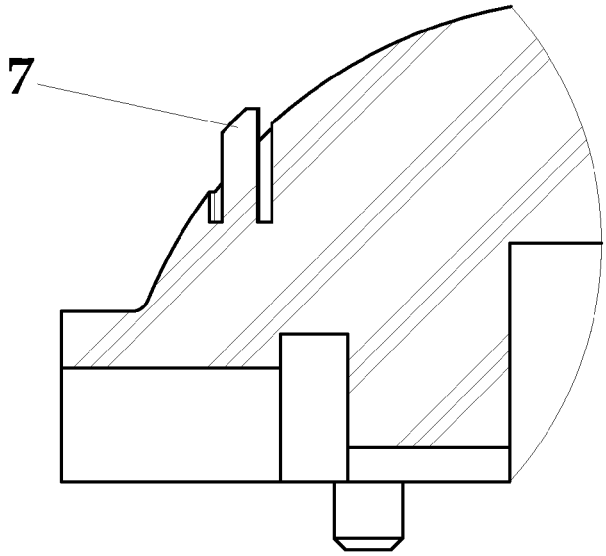
FIG. 2*b* is a pictorial of a cross section along line IIA of FIG. 2*a;*

Referring now to FIG. 2*b*, shown is a pictorial of a cross section along line IIA of FIG. 2*a*. Each semispherical half 3 of the light ball housing may have 3 preload pads 7, yielding a total of 6 on the assembled light ball 2, although not limited thereto. In one embodiment, the diameter of the assembled light ball 2 may be substantially in the range of 0.7-1", although not limited thereto, such as, for example, 0.850", so that it can be utilized with landscape edging having a corresponding size. In this embodiment, the recess into which the assembled light ball 2 is disposed, discussed further below, may have a diameter slightly larger than the assembled light ball 2 substantially in the range of 0.74"-1.04", although not limited thereto, such as, for example, 0.890". Each preload pad 7 may have a post that has dimensions with ranges of 0.05-0.15" tall, 0.01-0.05" wide, and 0.05-0.064" deep, although not limited thereto, such as, for example, 0.10" tall, 0.03" wide, and 0.057" deep. Each post may rise out of the protected pad recess 8 and above the surface of the ball in the range of 0.02-0.03", although not limited thereto, such as, for example, 0.025", to engage the recess into which the assembled light ball 2 is disposed. Each preload pad 7 may have an angled tip such as, although not limited thereto, substantially 45 degrees, and may be rounded so that its engagement with the recess provides friction, but still allows the orientation of assembled light ball 2 to be adjusted. Ideally there may be some pressure on all of the preload pads 7.

Figure 3:
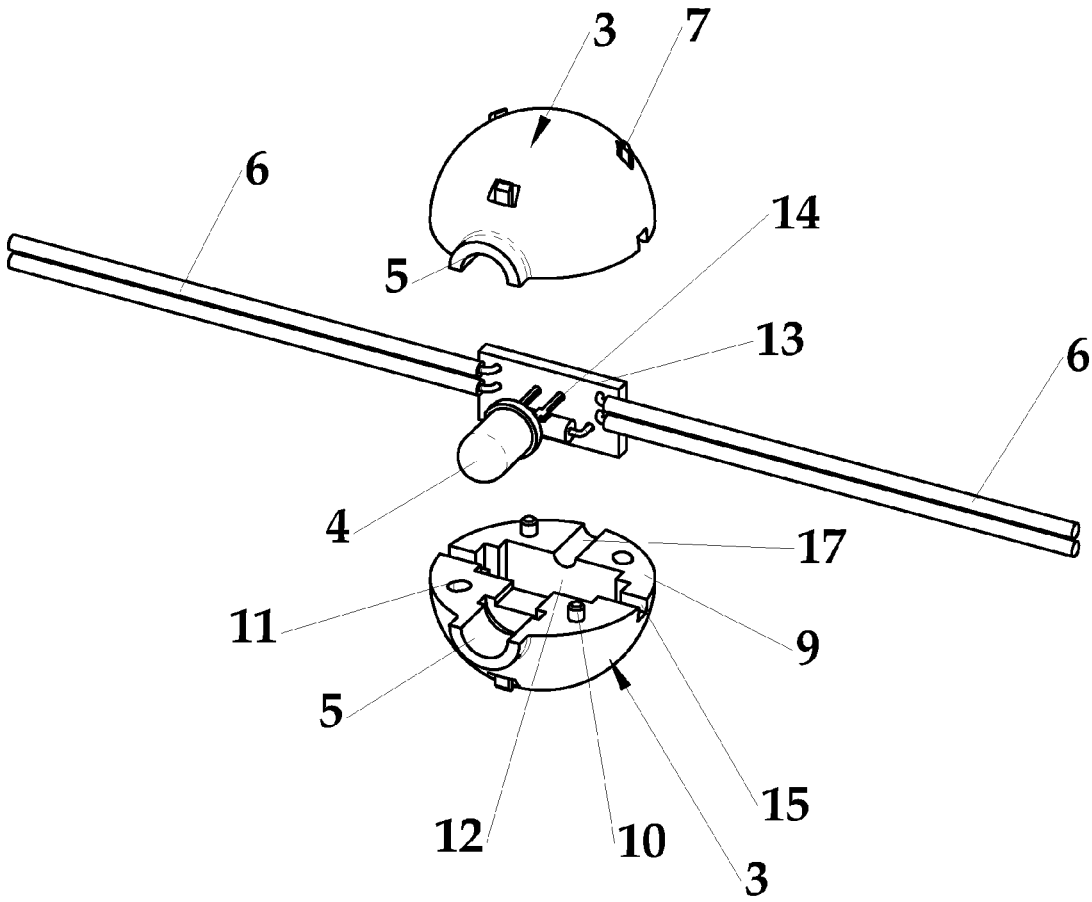
FIG. 3 is an exploded pictorial view of one embodiment of the light ball assembly.

Referring now to FIG. 3, shown is an exploded pictorial view of one embodiment of the light ball assembly 1. Two semispherical halves 3 may have at their mating surfaces 9 one or more locator pins 10 that mate with corresponding pin recesses 11, which help to align and strengthen the assembled light ball 2 when the semispherical halves 3 are joined. An additional subassembly recess 12 may securely hold a printed circuit board 13 onto which at least one light source 4 may be mounted by electrical contacts 14. Electrical wires 6 are attached to the printed circuit board 13 and exit through suitable wire openings 15 in order to connect the light ball assembly 1 to further light fixtures and a power source.

The light source 4 is contained or surrounded by the reinforced light recess 5, reinforced so as to completely hold and protect the light source 4 from damage. The two semispherical halves 3 are fixed together such as, but not limited to, by being glued together after inserting the printed circuit board 13 and light source 4. An additional suitable sealant opening 17 is provided to allow the insertion of apparatus to fill the remaining void inside the assembled light ball 2 with a sealant such as, but not limited to, an epoxy-like substance to protect against moisture and damage.

Figure 4A:
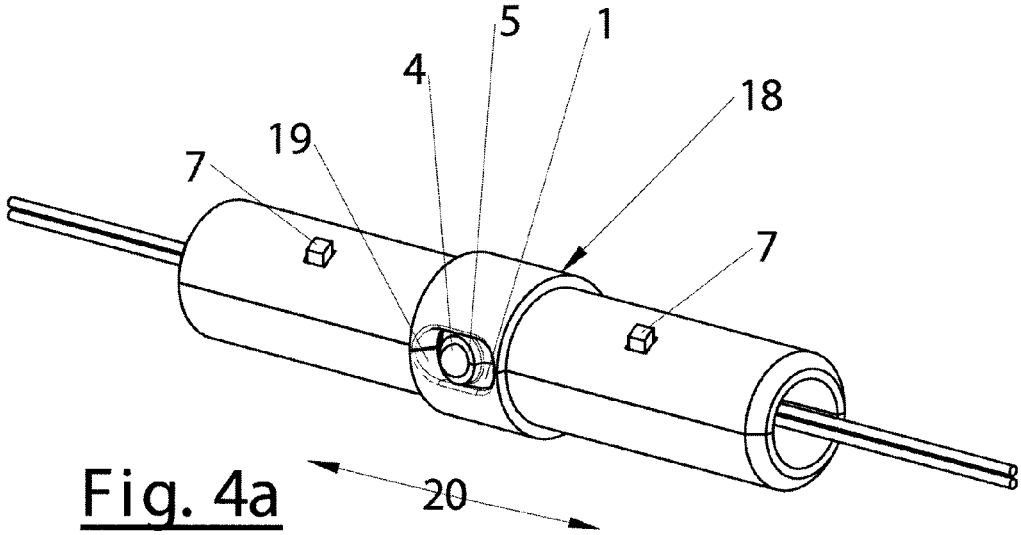
FIG. 4*a* is a pictorial view of one embodiment of the light ball assembly disposed in an elongated housing.

Referring now to FIG. 4*a*, shown is a pictorial view of one embodiment of the light ball assembly 1 disposed in an elongated housing 18. In this embodiment, the elongated housing 18 has an elongated light opening 19, which provides a way for the light source 4 inside the reinforced light recess 5 to be directed in multiple directions, such as with left or right movement 20, by changing the orientation of the assembled light ball 2 in relation to the elongated housing 18. Friction provided by the preload pads 7 on the assembled light ball 2 assure it stays in place once adjusted in a particular direction. The elongated light opening 19 could be in any number of shapes that permit the light source 4 to be directed and it is not limited to this particular embodiment. For example, it could allow the light source 4 in the assembled light ball 2 to move left and right, up and down, or a combination of those directions, although not limited thereto. In addition, another set of preload pads 7 may be provided on the elongated housings 26 as shown in FIGS. 4*a*, 5 and 6 to functionally engage the interior of receiving members or hollow tops 25, respectively.

Figure 4B:
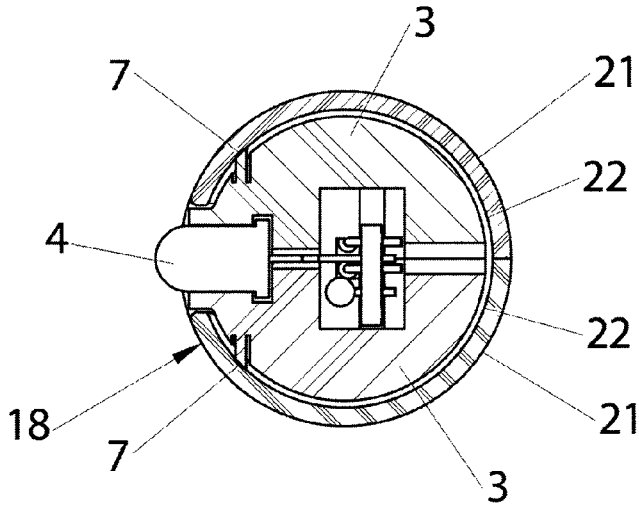
FIG. 4*b* is a pictorial of a cross-section of one embodiment of the elongated housing and light ball assembly.

Referring now to FIG. 4*b*, shown is a pictorial of a cross-section of one embodiment of the elongated housing 18 and light ball assembly. The preload pads 7 of the semispherical halves 3 engage the inside of the light ball recess 22 created by the elongated halves 21 in order to provide friction and maintain orientation of the light source 4. Similarly, the outside of the elongated halves 21 may also have preload pads that engage the inside of an enveloping member such as landscape edging, discussed below.

Figure 5:
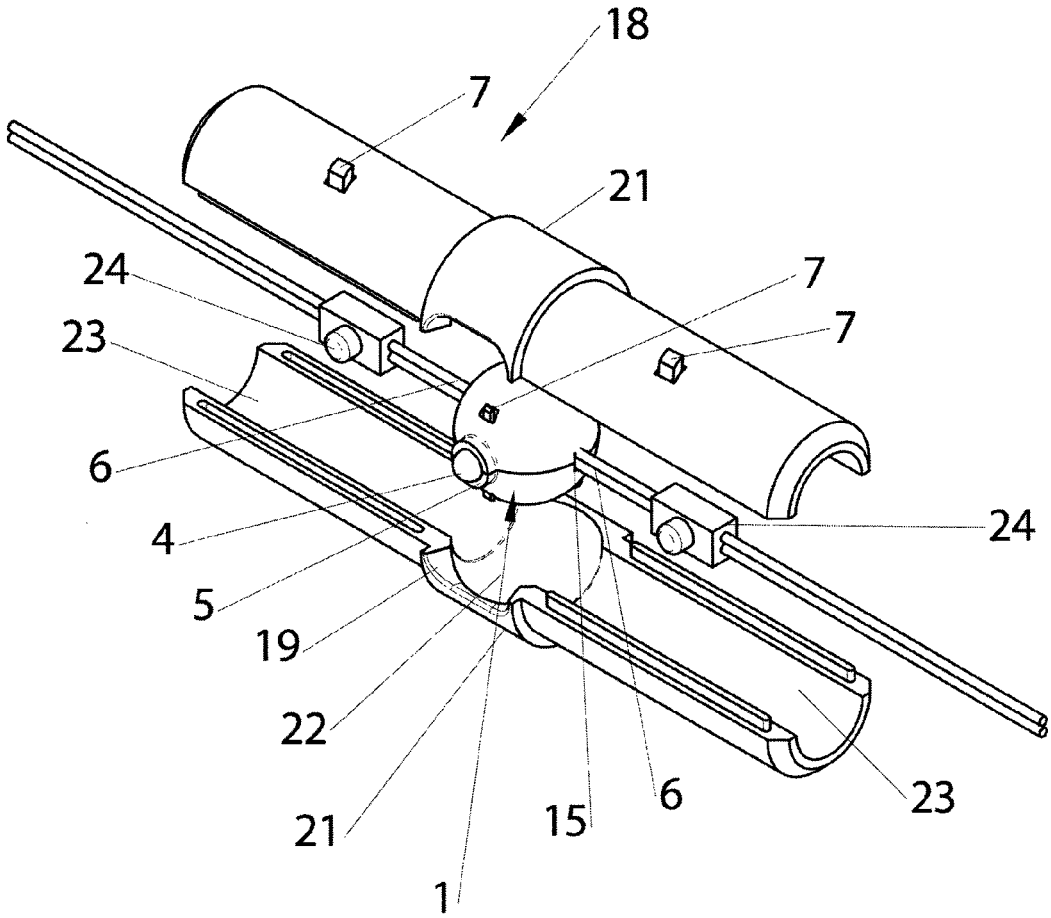
FIG. 5 is an exploded pictorial view of one embodiment of the light ball assembly disposed in an elongated housing.
Figure 6:
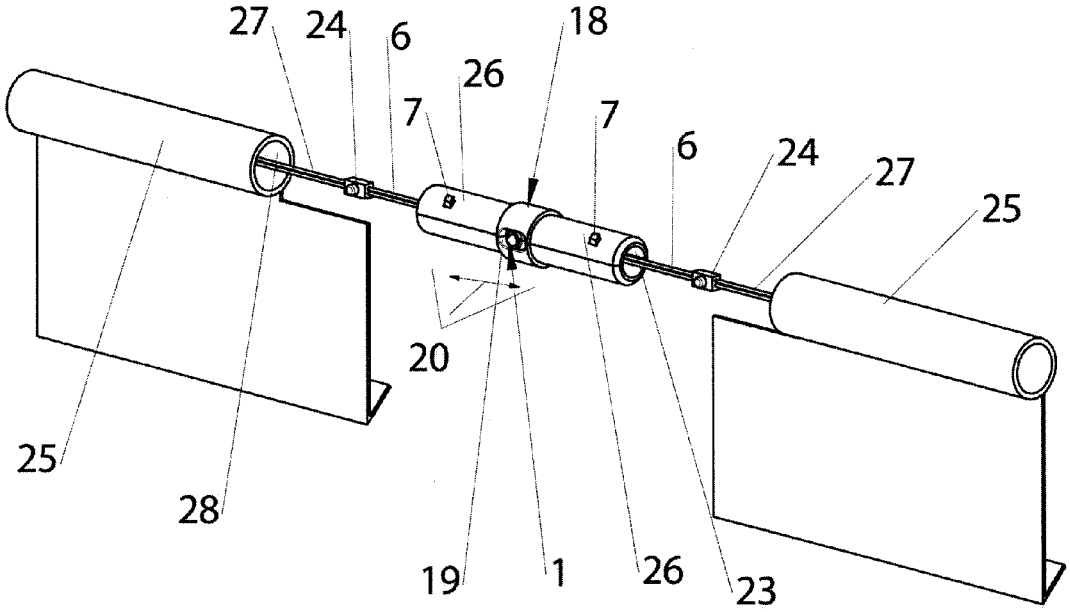
FIG. 6 is a pictorial view showing an embodiment of the universal light ball system incorporated into landscape edging.

Referring now to FIG. 5, shown is an exploded pictorial view of one embodiment of the light ball assembly 1 disposed in an elongated housing 18. The elongated housing 18 may be comprised of two elongated halves 21 for manufacturing efficiencies. Each elongated half 21 may be injection molded plastic or manufactured with some similar method and may be substantially similar in shape. The light ball assembly 1 is shown disposed within a suitable light ball recess 22 that has an elongated light opening 19 through which the light source 4 directs light. Preload pads 7 keep the otherwise loose light ball assembly 1 located in the desired orientation by the friction generated through the flexure of the preload pads 7 inside the elongated housing 18.

In this embodiment, each end of the elongated housing 18 has a large tubular recess 23, thus allowing the electrical wires 6 that exit from their respective wire openings 15 on the assembled light ball 2 to connect to further light fixtures or a power source. The tubular recesses 23 in the ends of elongated housing 18 protect the electrical wires 6 and provide space for any required snap connectors 24, which may be used to connect the electrical wires 6 to further light fixtures or a power source.

Referring now to FIG. 6, shown is a pictorial view showing an embodiment of the universal light ball system incorporated into landscape edging. In this embodiment the hollow edging top 25 of commercially available landscape edging has been cut back by a length that corresponds to the length of one of the tubular end sections 26 of the elongated housing 18. After inserting a set of interconnecting wires 27 from a power source or other light fixture, a snap connector 24 may be used to connect the electrical wires 6. The snap connector 24 can then be pushed inside the tubular recess 23 of its respective tubular end section 26 for protection against the elements.

In this embodiment, the outside diameters of the two tubular end sections 26 have a slightly smaller diameter to substantially match and be inserted within the inside diameter 28 of the hollow edging top 25 of the landscape edging. The elongated housing 18 can fully rotate within the hollow edging top 25. Combined with the described left or right movement 20 inside the elongated light opening 19, this allows the light source 4 to be directed in many desired angles.

Once assembled, the bottom of the landscape edging containing the universal light ball system can be buried at a desired location. The light source 4 can then be directed in any number of positions close to the ground in a inconspicuous way. The elongated housing 18 may optionally have attachment means for securing to the landscape edging. This may provide for additional structure support and strength to keep the pieces of landscape edging aligned and secured to each other and the elongated housing 18. To accomplish this, the elongated housing 18 may have clamping means along its bottom that affix to each of the sections of landscape edging, although not limited thereto.

Figure 7:
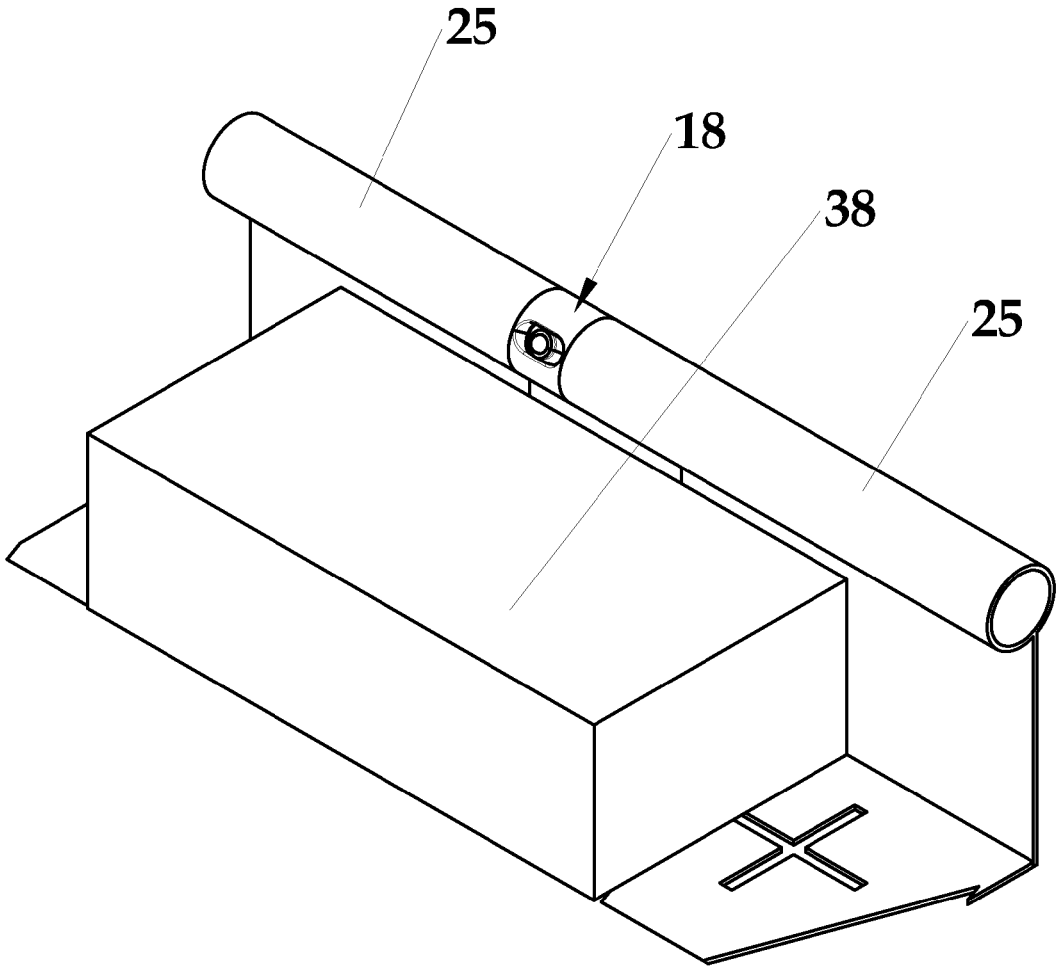
FIG. 7 is a pictorial view of another embodiment of the universal light ball system disposed in landscape edging.

Referring now to FIG. 7, shown is a pictorial view of another embodiment of the universal light ball system disposed in landscape edging. This type of landscape edging could be used next to paving 38 or a lawn, although there are many other possible uses of the universal light ball system that may be accomplished by adapting the elongated housing 18 to the desired application, including insertion into hollow top edging 25.

Figure 8A:
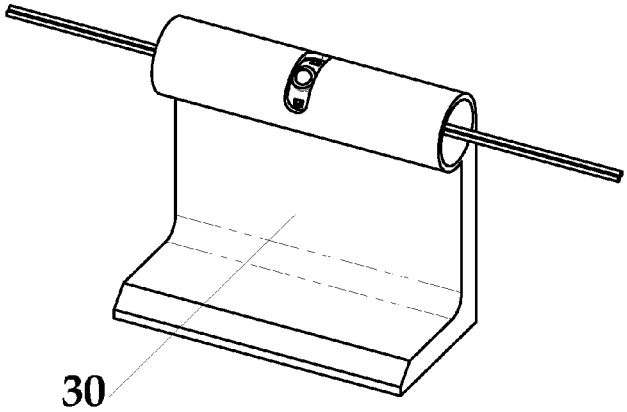
FIGS. 8*a*, 8*b* and 8*c* are pictorial views of an embodiment of the universal tubular light system.
Figure 8C:
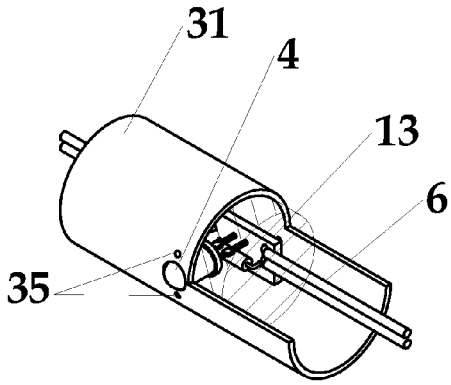
Figure 8B:
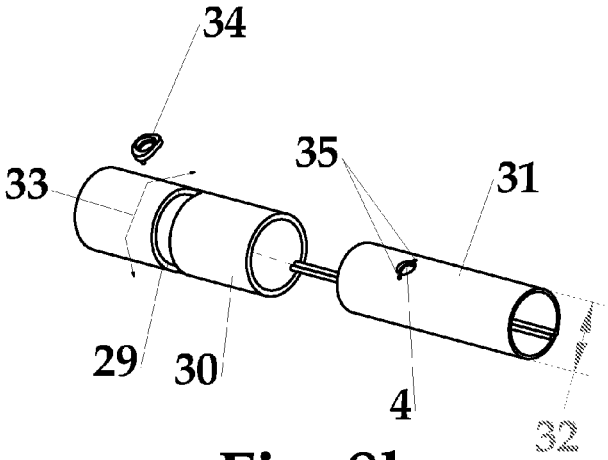

Referring now to FIGS. 8*a*, 8*b* and 8*c*, shown are pictorial views of an embodiment of the universal tubular light system. The universal tubular light system may comprise elongated housing containing a light source 4, without the need for a round housing disposed therein, although not limited thereto. This may allow the light source 4 to be directed with the rotation of the elongated housing. A tubular light section 31 may be disposed in hollow edging top 25 (shown in FIG. 7) or could be adapted for use inside or outside. Shown is the tubular light section 31 with indoor floor molding with hollow top 30, although not limited to this embodiment. Floor molding is often used in building interiors and can be adapted with a hollow top in order to provide effective lighting. The tubular light section 31 is preferably extruded to an outside dimension 32 that is matched to the respective inside dimension of the floor molding with hollow top 30 in such a way as to allow insertion of the tubular light section 31. A slot opening 29 may be machined directly into the floor molding with hollow top 30 in order to allow the light source 4 to be directed in predetermined up and down movement 33.

Referring now to FIG. 8*b*, a separate device, such as, but not limited to, a special button 34 may optionally be provided, capable of engaging button holes 35 located in the tubular light section 31. The purpose of such a special button 34 is to maintain correct alignment of the light source 4 of the tubular light section 31 inside the floor molding with hollow top 30. The special button 34 may have pins which align with the button holes 35. The special button 34 may then snap into place, be glued, or be affixed by some similar method, and the light source is restricted from orienting in any angle other than up and down movement 33. This permits the tubular light section 31 to rotate only within the range of the slot opening 29, which may constructed in any number of sizes and shapes.

Referring now to FIG. 8*c*, shown is a cut away view of the universal tubular light system, showing the light source 4, the printed circuit board 13 and the electrical wires 6. The button holes 35 facilitate rotation of the tubular light section 31 within an enveloping member and assure alignment of the light source 4 out of a slot opening 29. For protection against moisture and against other damage, the assembly including the light source 4 and printed circuit board 13 can be encased inside a sealant such as, but not limited to, an epoxy-like substance to protect against moisture and damage.

Figure 9A:
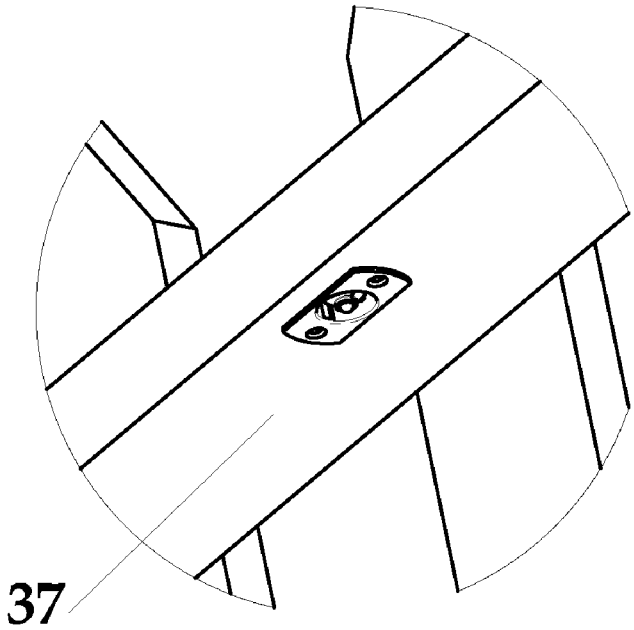
FIG. 9*a* is a pictorial view of another embodiment of the universal light ball system disposed in a box section, such as one found in fencing.

Referring now to FIG. 9*a*, shown is a pictorial view of another embodiment of the universal light ball system disposed in a box section, such as one found in fencing, which is common on perimeter fencing and other installations. The universal light ball system can be manufactured in any number of different surface mounted housing 36 designs for any number of different applications. Surface mount housing 36 allows the light system to be disposed inside of the hollow PVC fencing 37, or some other type of fencing or similar structure, so that it has a flush surface and provides inconspicuous directional light.

Figure 9B:
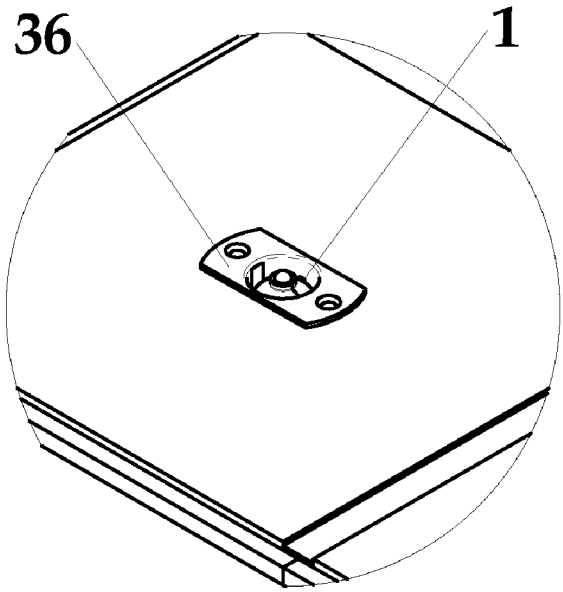
FIG. 9*b* is a pictorial view of another embodiment of the universal light ball system disposed in a drop ceiling.

Referring now to FIG. 9*b*, shown is a pictorial view of another embodiment of the universal light ball system disposed in a drop ceiling. This embodiment illustrates the many different types of uses for the light ball assembly 1, depending on the desired application. In this embodiment, the surface mount housing 36 is mounted flat into a ceiling tile in a drop ceiling that has a flat surface, again providing inconspicuous directional light. It is to be understood that many shapes of a housing are possible, depending on the mounting surface or the individual requirements of an application and the light system is not limited to these particular embodiments.

Figure 10:
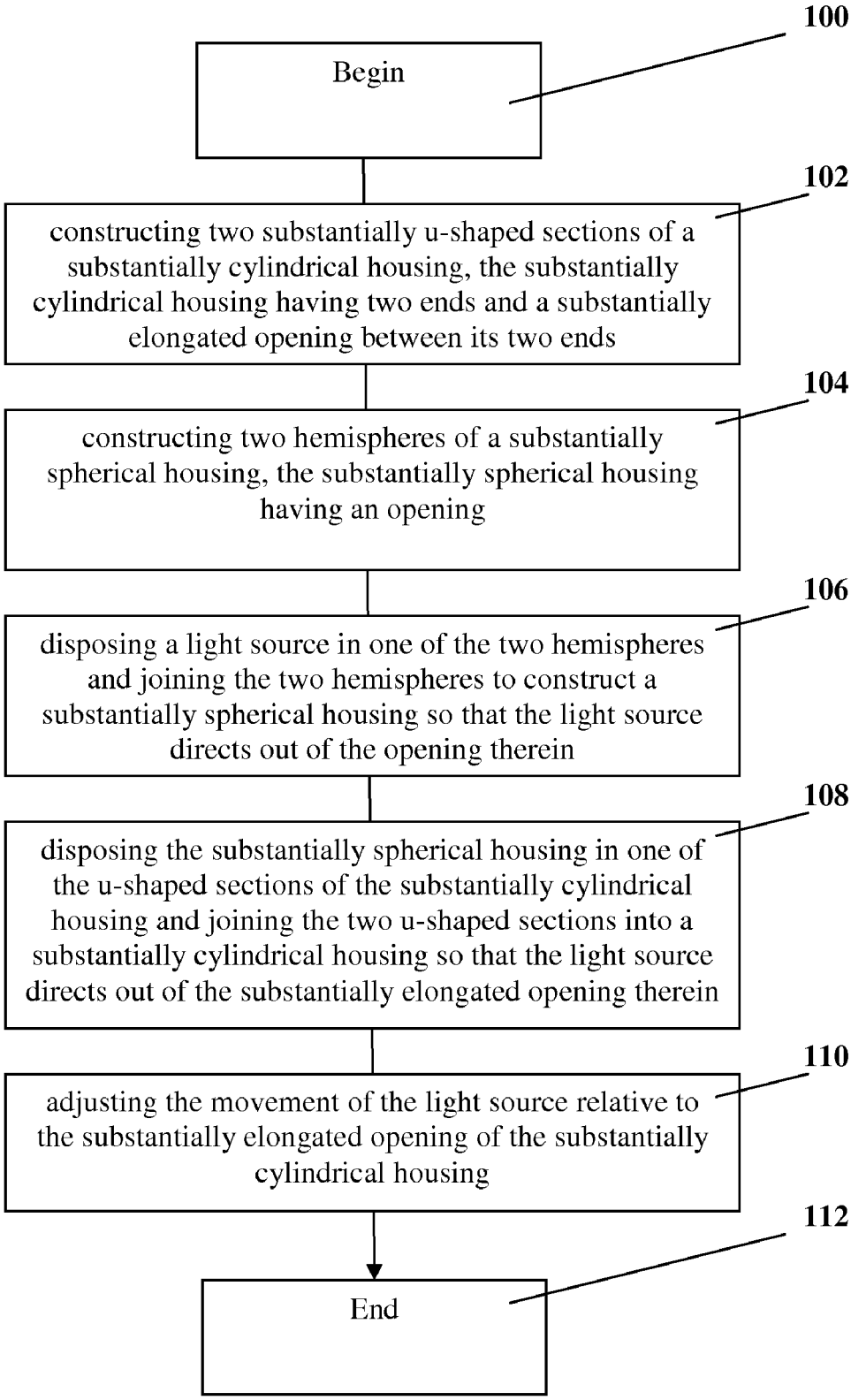
FIG. 10 is a block diagram describing one embodiment of the method of manufacturing the system.

Referring now to FIG. 10, shown is a block diagram describing one embodiment of the method of manufacturing the system. The following steps may take place: constructing two substantially u-shaped sections of a substantially cylindrical housing, the substantially cylindrical housing having two ends and a substantially elongated opening between its two ends 102; constructing two hemispheres of a substantially spherical housing, the substantially spherical housing having an opening 104; disposing a light source in one of the two hemispheres and joining the two hemispheres to construct a substantially spherical housing so that the light source directs out of the opening therein 106; disposing the substantially spherical housing in one of the u-shaped sections of the substantially cylindrical housing and joining the two u-shaped sections into a substantially cylindrical housing so that the light source directs out of the substantially elongated opening therein 108; and adjusting the movement of the light source relative to the substantially elongated opening of the substantially cylindrical housing 110.

While the present teachings have been described above in terms of specific embodiments, it is to be understood that they are not limited to these disclosed embodiments. Many modifications and other embodiments will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. A lighting system, comprising:

a substantially elongated housing having a first end, a second end, an internal recess connecting the first end and the second end, and a substantially elongated opening between the first end and the second end, a light source having a substantially round housing disposed in the substantially elongated housing adjacent to the substantially elongated opening thereof, one or more preload pads on the substantially round housing of the light source to provide a predetermined level of friction within the substantially elongated housing, at least one electrical wire connected to the light source and at least partially disposed in the internal recess of the substantially elongated housing, and wherein adjusting the orientation of the substantially round housing of the light source relative to the substantially elongated opening of the substantially elongated housing changes the direction of light emitted by the light source.

2. The lighting system of claim 1 wherein the at least one electrical wire includes both a supply wire and a return wire.

3. The lighting system of claim 1 further comprising a second electrical wire connected to the light source and at least partially disposed in the internal recess of the substantially elongated housing.

4. The lighting system of claim 1 further comprising a snap connector on the at least one electrical wire for connecting another electrical wire.

5. The lighting system of claim 1 wherein the light source includes a light emitting diode.

6. The lighting system of claim 1 further comprising a second light source directed in a different direction from the first light source.

7. The lighting system of claim 1 further comprising a sealant disposed in the substantially round housing of the light source to protect components therein.

8. The lighting system of claim 1 wherein the substantially elongated housing fits at least partially within a receiving member.

9. The lighting system of claim 8 further comprising one or more preload pads on the substantially elongated housing to provide a predetermined level of friction with the receiving member.

10. The lighting system of claim 8 wherein the receiving member is a hollow top of landscape edging.

11. The lighting system of claim 10 wherein the lighting system is secured to a section of landscape edging.

12. The lighting system of claim 8 wherein the receiving member is indoor molding.

13. The lighting system of claim 8 wherein the receiving member is a drop ceiling panel.

14. The lighting system of claim 8 wherein the receiving member is a fence.

15. The lighting system of claim 1 wherein:

the substantially elongated housing is constructed in the form of two substantially u-shaped sections of a substantially cylindrical shape, and the substantially round housing is constructed with two hemispheres of a substantially spherical shape.

16. The lighting system of claim 15 further comprising:

a plurality of preload pads on the substantially round housing to provide a predetermined level of friction with the inside of the substantially elongated housing.

17. A method of manufacturing a lighting system, comprising the steps of:

constructing two substantially u-shaped sections of a substantially cylindrical housing, the substantially cylindrical housing having two ends and a substantially elongated opening between its two ends, constructing two hemispheres of a substantially spherical housing, the substantially spherical housing having an opening, disposing a light source in one of the two hemispheres and joining the two hemispheres to construct a substantially spherical housing so that the light source directs out of the opening therein, disposing the substantially spherical housing in one of the u-shaped sections of the substantially cylindrical housing and joining the two u-shaped sections into a substantially cylindrical housing so that the light source directs out of the substantially elongated opening therein, and adjusting the position of the light source relative to the substantially elongated opening of the substantially cylindrical housing to change the direction of light emitted from the lighting system.

* * * * *